US007344812B2

(12) United States Patent
Suzuki et al.

(10) Patent No.: US 7,344,812 B2
(45) Date of Patent: Mar. 18, 2008

(54) DEVELOPER FOR DEVELOPING ELECTROSTATIC LATENT IMAGE AND IMAGE FORMING APPARATUS

(75) Inventors: Kohsuke Suzuki, Numazu (JP); Satoshi Mochizuki, Numazu (JP); Tomio Kondou, Numazu (JP); Masahide Yamashita, Numazu (JP); Tomomi Tamura, Numazu (JP); Takayuki Koike, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/391,575

(22) Filed: Mar. 20, 2003

(65) Prior Publication Data

US 2003/0180643 A1 Sep. 25, 2003

(30) Foreign Application Priority Data

Mar. 22, 2002 (JP) ..... 2002-081601

(51) Int. Cl.
*G03G 9/113* (2006.01)

(52) U.S. Cl. ..... 430/108.1; 430/110.1; 430/111.35; 430/107.1; 430/123.5; 430/123.58

(58) Field of Classification Search ..... 430/110.1, 430/111.35, 111.32, 108.6, 108.1, 123.58, 430/123.5

See application file for complete search history.

(56) References Cited

U.S. PATENT DOCUMENTS 4,814,253 A * 3/1989 Gruber et al. ..... 430/110.1
5,380,616 A * 1/1995 Aoki et al. ..... 430/110.1
6,042,981 A * 3/2000 Barbetta et al. ..... 430/111.1
6,100,332 A * 8/2000 Yoshikawa et al. ..... 525/101
6,258,502 B1 7/2001 Nakamura et al.
6,268,099 B1 * 7/2001 Eguchi et al. ..... 430/108.8
6,363,229 B1 3/2002 Shiraishi et al.
6,403,275 B1 6/2002 Kuramoto et al.
6,406,826 B1 6/2002 Suzuki et al.
6,500,595 B1 12/2002 Mochizuki et al.
2002/0136975 A1 * 9/2002 Shiraishi et al. ..... 430/110.1

FOREIGN PATENT DOCUMENTS

EP 1260874 A1 * 11/2002
JP 04070672 A * 3/1992

OTHER PUBLICATIONS

Diamond, Arthur S. (editor) Handbook of Imaging Materials. New York: Marcel-Dekker, Inc. (1991) pp. 162, 163, 201-203, 210-215.*
U.S. Appl. No. 11/378,424, filed Mar. 20, 2006, Suzuki et al.
U.S. Appl. No. 11/558,736, filed Nov. 10, 2006, Uchinokura et al.
U.S. Appl. No. 11/608,521, filed Dec. 8, 2006, Satoru et al.
U.S. Appl. No. 11/687,404, filed Mar. 16, 2007, Seshita et al.
U.S. Appl. No. 11/687,875, filed Mar. 19, 2007, Kojima et al.
U.S. Appl. No. 10/875,402, filed Jun. 25, 2004, Sugiura et al.
U.S. Appl. No. 10/872,438, filed Jun. 22, 2004, Takeuchi et al.
U.S. Appl. No. 10/844,442, filed May 13, 2004, Yamashita et al.
U.S. Appl. No. 11/189,692, filed Jul. 27, 2005, Suzuki et al.
U.S. Appl. No. 11/184,976, filed Jul. 20, 2005, Sugiura et al.
U.S. Appl. No. 10/752,589, filed Jan. 8, 2004, Masuda et al.
U.S. Appl. No. 10/766,874, filed Jan. 30, 2004, Yamashita et al.
U.S. Appl. No. 10/759,029, filed Jan. 20, 2004, Sugiura et al.
U.S. Appl. No. 10/784,204, filed Feb. 24, 2004, Umemura et al.
U.S. Appl. No. 10/253,491, filed Sep. 25, 2002, Kondou et al.
U.S. Appl. No. 10/135,377, filed May 1, 2002, Yamaguchi et al.
U.S. Appl. No. 10/176,578, filed Jun. 24, 2002, Yagi et al.
U.S. Appl. No. 10/158,069, filed May 31, 2002, Matsuda et al.

(Continued)

*Primary Examiner*—Christopher RoDee
(74) *Attorney, Agent, or Firm*—Oblon, Spivak, McClelland, Maier & Neustadt, P.C.

(57) ABSTRACT

A developer for developing an electrostatic latent image, including a carrier which includes core particles, and a surface layer surrounding each of the core particles and containing an acrylic resin binder; and a toner which includes toner particles and an external additive of inorganic or organic fine particles present on each of the toner particles. Each of the toner particles comprises a colorant, a matrix of a first resin, and a plurality of domains of a second resin dispersed in the matrix and containing a wax. The first resin is substantially free of tetrahydrofuran insoluble matters and has a weight average molecular weight of 3,000 to 90,000.

8 Claims, No Drawings

OTHER PUBLICATIONS

U.S. Appl. No. 10/020,925, filed Dec. 19, 2001, Mochizuki et al.
U.S. Appl. No. 10/101,756, filed Mar. 21, 2002, Matsuda et al.
U.S. Appl. No. 10/059,240, filed Jan. 31, 2002, Sugiura et al.
U.S. Appl. No. 10/086,415, filed Mar. 4, 2002, Sugiura et al.
U.S. Appl. No. 10/079,878, filed Feb. 22, 2002, Katoh et al.
U.S. Appl. No. 10/107,157, filed Mar. 28, 2002, Matsuda et al.
U.S. Appl. No. 10/059,239, filed Jan. 31, 2002, Mochizuki et al.
U.S. Appl. No. 09/988,142, filed Nov. 19, 2001, Kotsugai et al.
U.S. Appl. No. 09/993,606, filed Nov. 27, 2001, Kotsugai et al.
U.S. Appl. No. 09/985,738, filed Nov. 6, 2001, Sugiura et al.
U.S. Appl. No. 09/845,449, filed Apr. 30, 2001, Per Client.
U.S. Appl. No. 09/843,357, filed Apr. 26, 2001, Per Client.
U.S. Appl. No. 09/709,795, filed Nov. 10, 2000, Per Client.

* cited by examiner

DEVELOPER FOR DEVELOPING ELECTROSTATIC LATENT IMAGE AND IMAGE FORMING APPARATUS

BACKGROUND OF INVENTION

The present invention relates to a developer and a color developer for developing an electrostatic latent image in electrophotography, electrostatic recording, electrostatic printing and so on. The present invention also relates to an image forming apparatus for forming an image using the developer.

In electrophotographic image formation, charged toner particles are attached to a latent image formed on an image carrier of a photoconductive material to form a visible toner image, which in turn is transferred onto a recording medium such as a sheet of paper and fixed into an output image.

In recent years, the technology of copiers and printers is rapidly shifting from monochrome to full color, and the market for full-color devices is expanding. In full-color electrophotographic image formation, all colors are reproduced by overlaying toner images of the primary colors, which are cyan, magenta, and yellow, or toner images of the three colors and black. Thus, in order to obtain a sharp color image with high color reproduction, the surface of a fixed toner image must be relatively smooth to reduce scattering of light. This is the reason that many of conventional full color copiers or the like are designed to produce a relatively high gloss of 10 to 50%.

In general, fixation of a dry toner image on a recording medium is carried out by a contact-heat fixing method in which a roller or belt having a smooth surface is heated and pressed against the toner image. This method is thermally efficient and permits high-speed fixation, and can provide gloss and transparency to color images. However, since the surface of the heat fixing member is brought into pressure contacted with toner in a molten state and removed therefrom, a so-called offset phenomenon occurs in which part of the toner image adheres to the surface of the fixing roller and is transferred onto another image.

For the purpose of prevention of the offset phenomenon, a method has been widely adopted in which a releasing oil such as a silicone oil is applied to a surface of a fixing roller made of a material with high releasing properties such as a silicone rubber or a fluororesin. This method is very effective to prevent offset of toner, but needs a device for supplying a releasing oil and thus increases the size and cost of the fixing unit. Thus, in monochrome toners, the viscoelasticity of toner in a molten state is increased by, for example, controlling the molecular weight distribution of the binder resin to prevent internal breakage of the molten toner and a releasing agent such as a wax is added in the toner so that fixation can be made without or with a small amount of releasing oil.

In color toners, however, the viscoelasticity of toner in a molten state must be decreased to smooth the surface of a fixed image in order to improve color reproduction. Thus, color toners are more likely to cause offset than monochrome toners and cannot be fixed without application of releasing oil to a fixing roller. Also, when a releasing agent is added in a toner, it increases adhesion of toner, deteriorating the transferability of the toner. In addition, the releasing agent in the toner contaminates the triboelectrifying members such as carrier, lowering the chargeability and duration thereof.

Conventionally, low-molecular weight binder resins with which gloss can be easily obtained, such as polyester resins and epoxy resins, are used in color toners. These resins, however, contain a hydrophilic group and thus cause fluctuations of the charge amount of the developer with changes of humidity. In recent years, the trend is toward small particle size toners for high-quality images. Polyester resins and epoxy resins are inferior in grindability to styrene resins conventionally used as binder resins for monochrome toners.

Under such circumstances, various types of toners have been proposed. For example, Japanese Laid-Open Patent Publication H08-220808 discloses a toner comprising a linear polyester resin having a softening point of 90-120° C. and a carnauba wax. Japanese Laid-Open Patent Publication H09-106105 discloses a toner comprising a resin and a wax which are compatible with each other and have different softening points. Japanese Laid-Open Patent Publication H09-304964 discloses a toner comprising a polyester resin and a wax each having a specific melt viscosity. Japanese Laid-Open Patent Publication H10-293425 discloses a toner containing a polyester resin having a softening point of 90-120° C., a rice wax, a carnauba wax and a silicone oil. Japanese Laid-Open Patent Publication H05-61242 proposes a wax-containing toner produced by polymerization. However, a toner which does not cause offset with a fixing method in which no or only a small amount of oil is applied to a fixing roller and which is excellent in transferability, duration, charge stability against humidity and grindability has not been obtained yet.

As for carriers, a coating layer with high hardness and strength of a suitable resin material is often provided on carrier particles for the purpose of prevention of filming of toner components on surfaces of the carrier particles, formation of uniform carrier particle surfaces, prevention of surface oxidation and lowering of moisture sensitivity, extension of the service life of developer, prevention of adhesion of carrier particles to a photoconductor surface, protection of a photoconductor from scratches and abrasion by the carrier particles, control of charging polarity, adjustment of charge amount and so on. For example, there are disclosed a carrier coated with a specific resin material (Japanese Laid-Open Patent Publication S58-108548), a carrier coated with a resin material containing various additives (Japanese Laid-Open Patent Publications S54-155048, S57-40267, S58-108549, S59-166968 and H06-202381, and Japanese Examined Patent Publications H01-19584 and H03-628), a carrier containing an additive present on surfaces of the particles thereof (Japanese Laid-Open Patent Publication H05-273789), and a carrier coated with a coating film containing conductive particles having a particle size which is larger than the thickness of the coating film (Japanese Laid-Open Patent Publication H09-160304). Japanese Laid-Open Patent Publication H08-6307 discloses the use of a composition mainly composed of a benzoguanamines-n-butyl alcohol-formaldehyde terpolymer as a carrier coating material. Japanese Patent No. 2683624 disclosed the use of a crosslinked product of a melamine resin and an acrylic resin as a carrier coating material.

However, none of the carriers are sufficient in duration and ability not to adhere to a photoconductor surface. As for the duration, there are problems of so-called "spent phenomenon", in which a toner film is formed on the surface of the carrier particles, and resulting fluctuation of charge amount, reduction of coating layer due to flaking of the coating resin and resulting lowering of resistivity and so on. Although high quality images can be obtained at an early stage of copying, the image quality decreases with increase of the number of copies produced. There is still room for improvement.

SUMMARY OF THE INVENTION

The present invention has been made in view of the above problems and it is, therefore, an object of the present invention to provide a developer for developing an electrostatic image which does not cause offset with a fixing method in which no or only a small amount of oil is applied to a fixing roller.

Another object of the present invention is to provide a developer which is excellent in transferability, duration, charge stability against humidity and grindability.

It is a further object of the present invention to provide a developer which can produce images with sharpness over a long period of time, and which can produce color images with moderate gloss and high color reproduction.

It is yet a further object of the present invention to provide an image forming apparatus for forming an image using the developer.

According to one aspect of the present invention, there can be provided a developer for developing an electrostatic latent image, comprising: a carrier which includes core particles, and a surface layer surrounding each of the core particles and containing an acrylic resin binder; and a toner which includes toner particles and an external additive of inorganic or organic fine particles present on each of the toner particles, each of the toner particles comprising a colorant, a matrix of a first resin, and a plurality of domains of a second resin dispersed in the matrix and containing a wax, wherein the first resin is substantially free of tetrahydrofuran insoluble matters and has a weight average molecular weight of 3,000 to 90,000.

In another aspect, the present invention provides an image forming apparatus for forming an image using the developer.

Other objects, features and advantages of the present invention will become apparent from the detailed description of the preferred embodiments of the invention to follow.

DETAILED DESCRIPTION OF THE PREFERRED EMBODIMENTS OF THE INVENTION

A developer for developing an electrostatic latent image according to the present invention comprises a carrier which includes core particles, and a surface layer surrounding each of the core particles and containing an acrylic resin binder, and a toner which includes toner particles and an external additive of inorganic or organic fine particles present on each of the toner particles. Each of the toner particles comprises a colorant, first and second resins, and a wax. The first and second resins and the wax are incompatible with one another and, thus, form a phase-separated structure in which a plurality of domains of the second resin are dispersed, like islands, in a matrix (sea) of the first resin. The first resin is substantially free of tetrahydrofuran insoluble matters and has a weight average molecular weight of 3,000 to 90,000. In one embodiment, the developer for developing an electrostatic latent image. comprises a carrier which comprises core particles and a surface layer comprising a resin binder which comprises an acrylic resin and a silicone resin surrounding each of said core particles; and a toner which comprises toner particles and an external additive of inorganic or resin fine particles present on each of said toner particles, wherein each of said toner particles comprises a colorant, a matrix of a first resin, domains of a second resin and a wax; wherein and a plurality of domains of said second resin is dispersed in said matrix of said first resin, and wherein said second resin substantially contains said wax, said first resin, said second resin and said wax being insoluble in each other, said first resin is substantially free of tetrahydrofuran insoluble matters and has a weight average molecular weight of 3,000 to 90,000, and said surface layer comprises a first layer comprising said acrylic resin and a second layer comprising said silicone resin, said first and second layers being provided one over the other in either order to form a laminate.

The carrier, which has an acrylic resin-containing surface layer, can maintain a stable charge amount since the acrylic resin has high adhesion and low brittleness and thus is excellent in abrasion resistance, and does not suffer deterioration such as flaking or peeling.

The acrylic resin herein may be any resin containing an acrylic component. The acrylic resin may be used alone or in combination with one or more other components capable of crosslinking reaction. Illustrative of the other components capable of crosslinking reaction herein are amino resins such as guanamine and melamine resins, and acid catalysts such as completely alkylated type catalyst and catalyst having a reactive group such as a methylol group, imino group or methylol/imino group.

It is preferred that the surface layer of the carrier contain a silicone resin in addition to the acrylic resin. Acrylic resins have high adhesion and low brittleness and thus are excellent in abrasion resistance. However, acrylic resins have high surface energy and thus may cause a failure such as lowering of charge amount due to a spent phenomenon when combined with a toner which is easily ground into fine particles. This problem can be solved by using an acrylic resin in conjunction with a silicone resin, since silicone resins have low surface energy and easily have surface flakes so that accumulation of fine particles on the carrier particles does not increase. However, since silicone resins have low adhesion and high brittleness and thus are poor in abrasion resistance, it is necessary to balance the characteristics of the two types of resins to obtain a surface layer having satisfactory anti-spent properties and high abrasion resistance. The surface layer preferably has an acrylic resin content of 10-90% by weight for reasons of satisfactory abrasion resistance and prevention of accumulation of toner fine particles.

The silicone resin may be a straight silicone resin composed only of organosiloxane bonds or a modified silicone resin. Illustrative of suitable straight silicone resins are KR271, KR272, KR282, KR252, KR255, KR152 (products of Shinetsu Chemical Industry Co., Ltd.), SR2400, SR2406 and SR 2410 (products of Toray Dow Corning Silicone Inc.). The straight silicone resins may be used singly or in combination with a component capable of crosslinking reaction or a charge amount adjusting component. The modified silicone resin may be, for example, epoxy-modified silicone, acryl-modified silicone, phenol-modified silicone, urethane-modified silicone, polyester-modified silicone or alkyd-modified silicone. Illustrative of modified silicone resins are ES-1001N (epoxy-modified), KR-5208 (acryl-modified), KR-5203 (polyester-modified), KR-206 (alkyd-modified), KR-305 (urethane-modified) (above are products of Shinetsu Chemical Industry Co., Ltd.), SR2115 (epoxy-modified) and SR2110 (alkyd-modified) (products of Toray Dow Corning Silicone Inc.).

When the surface layer contains an acrylic resin and a silicone resin in combination, it is preferred that the surface layer have a layered structure in the form of a laminate comprising an acrylic resin layer and a silicone resin layer, since such a surface layer can exhibit as a whole desired combination of properties such as anti-spent properties, abrasion resistance, and adhering properties. In this case, it is also preferred that the silicone resin layer be provided as an outer layer having excellent anti-spent properties, and the acrylic resin layer be interposed as an inner layer between the core particles and the outer layer to provide strong adhesion therebetween.

It is further preferred that the surface layer of the carrier contain particles having a diameter which satisfies the following condition:

$$1<D/h<10$$

wherein D represents an average particle diameter of the particles and h represents the thickness of the surface layer. The inorganic particles are exposed from the surfaces of the surface layer and can ease impact thereto caused by collision with toner particles or other carrier particles when the developer is triboelectrified. Thereby, accumulation of toner fine particles on the carrier particles and flaking of the surface layer of the carrier particles can be prevented. When the D/h is not greater than 1, the particles are buried in the surface layer and the effect of the particles is lowered. When the D/h is 10 or higher, the contact areas between the particles and the surface layer are too small to hold the particles and the particles are easily removed.

The content of the particles in the surface layer components is preferably in the range of 40-95% by weight based on a total weight of the acrylic resin binder and the particles for reasons of satisfactory duration and charging properties. The carrier of Japanese Laid-Open Patent Publication No. H09-160304 has a surface layer containing particles as mentioned before. However, the content of the particles is 0.01 to 50% by weight of the coating resin, namely 0.01-33.33% by weight based on a total weight of the binder and the particles. Thus, the content of the particles on the surfaces of the carrier particles of the above Japanese publication is too low as compared with that of the binder resin that the effect of easing impact to the binder resin is small.

The particles may be any organic or inorganic particles other than carbon black. The organic particles may be, for example, polymer particles such as nylon particles, fluoro resin particles and melamine resin particles. Illustrative of suitable inorganic particles are alumina particles, titanium oxide particles, zinc oxide particles or mixtures thereof. The particles may have been subjected to surface treatment. The above particles, which have high tenacity against external stress and are not subjected to breakage or wearing, can maintain the effect of protecting the surface layer over a long period of time. The particles preferably have an average particle size of not greater than 5 μm, preferably 0.01 to 5 μm. When the surface layer has a layered structure, the particles are preferably present in the acrylic resin layer since the acrylic resin can hold the particles over a long period of time because of its high adhesion.

The surface layer may contain carbon black, if desired. Carbon black serves as a resistance adjusting agent for reducing the electric resistivity of the carrier. Carriers having a large resistivity are apt to cause the so-called edge effect, a phenomenon in which the image density of a center part of a large solid image is lighter than that of an edge part thereof, resulting in deterioration in reproduction of half-tones. Thus, the use of an adequate amount of carbon black can improve the image quality. Carbon black can be used in a carrier for color developer.

In the case of a carrier for a color developer, small pieces flaked off the surface layer of the carrier cause image deterioration when having a dark color because of carbon black contained therein or other reason. In the present invention, however, since the surface layer contains an acrylic resin having high adhesion and low brittleness, the carbon black can be strongly held in the surface layer. In addition, the surface layer itself is not easily flaked off. Thus, carbon black is hardly separated from the surface layer. In the surface layer having a tow-layer structure, carbon black is dispersed in the lower layer of an acrylic resin. Carbon black herein may be any carbon black generally used in carriers and toners. The amount of carbon black is generally, 0 to 25% by weight based on a total weight of the resin or resins in the surface layer and the carbon black. The carbon black preferably has an particle diameter of 10 to 1000 nm, more preferably 20 to 500 nm.

The core particles of the carrier preferably have an average particle size of 20-100 μm for reasons of prevention of adhesion (scattering) of carrier particles to the electrostatic latent image carrier and image defects such as streaking. Any conventionally employed core material for two-component developers may be used for the purpose of the present invention. Illustrative of carrier core materials include ferrite, magnetite, iron, and nickel.

As for the toner to be used in combination with the above carrier, the important features thereof are that each of the toner particles comprises first and second resins, that the first and second resins are incompatible with one another and form a phase-separated structure in which a plurality of domains of the second resin are dispersed, like islands, in a matrix (sea) of the first resin and that a wax is contained in the islands.

To ensure the structure, the first and second resins and the wax preferably meet the following softening point (SP):

$$SP \text{ value of first resin} > SP \text{ value of second resin} > SP \text{ value of wax.}$$

Further, the difference between the SP values of the first and second resins is preferably at least 0.6, When the first resin comprises two types of resins, the SP value of the first resin is a mean value obtained considering the mixing ratio of the two resins.

The amounts of the first and second resins and the wax are 55-96% by weight, 2-44% by weight, and 2-15% by weight, respectively, based on a total amount of the resins and the wax.

In a toner which includes toner particles having a sea-island structure in which a wax is dispersed, like islands, in the matrix of a resin, grinding stress tends to concentrate at the interfaces between the resin and the wax in grinding the toner particles, and the toner particles are likely to be broken at the interfaces. Thus, the wax is exposed on outer surfaces of the ground toner particles in a large amount. This lowers the image transferability and duration of the toner.

In the toner of the present invention, on the other hand, since a plurality of domains of the second resin is dispersed, like islands, in the matrix of the first resin and the wax is contained in the domains of the second resin, grinding stress can be also concentrated at the interfaces between the first and second resins. Thereby, the amount of wax exposed on the ground toner particles is reduced, and the transferability and duration of the toner is improved. Also, since the wax is present in areas in the vicinity of the surfaces of the toner particles, the offset properties of the toner is not adversely affected. In addition, the pulverizability or grindablilty of the toner is improved owing to an increase of incompatible interfaces where stress tends to concentrate. Thus, small-diameter toner particles can be produced with high efficiency.

In view of color reproduction, the toner can preferably provide an image gloss of at least 5%, preferably at least 10%. It is necessary that the first resin should be free of THF (tetrahydrofuran) insoluble matters and should have a weigh average molecular weight of 3,000 to 90,000, preferably 3,000 to 50,000, It is preferred that the second resin be free of THF insoluble matters and have a weigh average molecular weight of 3,000 to 60,000 for a reason of satisfactory anti-offset properties.

Illustrative of suitable binder resins for use as the first and second resins in the toner are homopolymers or copolymers of two or more of the following monomers: styrene or its homologues such as p-chlorostyrene, vinyltoluene, vinyl chloride, vinyl acetate, vinyl propionate, methyl (meth) acrylate, ethyl (meth)acrylate, propyl (meth)acrylate, n-butyl (meth)acrylate, isobutyl (meth)acrylate, dodecyl (meth) acrylate, 2-ethylhexyl (meth)acrylate, lauryl (meth)acrylate, 2-hydroxyethyl (meth)acrylate, hydroxypropyl (meth)acrylate, 2-chloroethyl (meth)acrylate, (meth)acrylonitrile, (meth)acrylamide, (meth)acrylic acid, vinyl ethyl ether, vinyl methyl ether, vinyl isobutyl ether, vinyl methyl ketone, N-vinyl pyrrolidone, N-vinylpyridine and butadiene. Other resins such as polyester resins, polyurethane resins, polyol resins, polyamide resins, epoxy resins, rosins, modified rosins, terpene resins, phenolic resins, hydrogenated petroleum resins, ionomer resins, silicone resins, ketone resins, and xylene resins may also be used. Mixtures of two or more of the above homopolymers, copolymers and resins may also be used.

Above all, polyester resins and polyol resins conventionally used in color toners are particularly suitable for the first resin. The polyol resins herein may be polyether polyol resins having an epoxy skeleton, and epoxy resins, alkyleneoxide adducts of a dihydric phenol or their glycidylether, and polyol resin which allow reaction of a compound containing a reactive hydrogen capable of an epoxy group with an epoxy group are preferably used.

As the second resin, styrene resins excellent in charge stability against humidity and grindability, especially styrene and alkyl (meth)acrylate copolymers, are preferably used. The second resin is also preferably a modified wax obtained by grafting a wax component with a vinyl resin, since such a modified wax serves to improve compatibility between the first resin and the releasing agent (wax), therefore, permits the releasing agent (wax) to be finely divided and since the amount of the releasing agent (wax) exposed on surfaces of toner particles is reduced. As a consequence, the transferability and duration of the toner may be further improved.

A releasing agent may be suitably incorporated into the toner. Any known releasing agent may be suitably used for the purpose of the present invention. Wax is generally used as a releasing agent. Examples of the wax include low molecular weight polyolefin wax such as low molecular weight polyethylene wax and low molecular weight polypropylene wax; synthetic hydrocarbon wax such as Fischer-Tropsh wax; natural wax such as carnauba wax, candelilla wax, rice wax, montan wax; petroleum wax such as paraffin wax and microcrystalline wax; higher fatty acids such as stearic acid, palmitic acid and millystyric acid; metal salts or amides of higher fatty acids; synthetic ester wax; and modified waxes of the above waxes. Above all, carnauba wax, modified carnauba wax and synthetic ester wax are suitably used since these waxes are dispersed adequately finely in polyester resins and polyol resins and make it possible to obtain a toner excellent in anti-offset properties, transferability and duration.

These waxes may be used singly or in combination of two or more thereof. It is preferred that the wax have a melting point in the range of 70° C. to 125° C. for reasons of satisfactory transferability, duration and releasability. The wax preferably has a penetration of 5 or lower. A wax having a penetration of 5 or lower has an adequate hardness and can prevent the external additive particles from being buried into the toner particles. The releasing agent is generally used in an amount of 2 to 15% by weight based on the weight of the toner.

In one embodiment, the first resin, the second resin and the wax are insoluble in each other.

The wax must be contained or dispersed in the second resin. The maximum dispersion diameter (major axis) of the wax in the toner particles is preferably ½or smaller of the maximum diameter of the toner particles, more preferably at least 0.5 μm and not greater than ⅓of the maximum diameter of the toner particles for reasons of satisfactory transferability, duration and anti-offset properties. The maximum dispersion diameter of the wax is obtained by mixing the toner with a solvent which dissolves the resins but does not dissolve the wax and observing the wax particles in the solvent with an optical microscope under a magnification of 1,000, The diameter of the toner particles is measured with a Coulter counter, and the mean value of the channel in which particles with the largest diameter are present is adopted as the maximum diameter of the toner particles. The SP value of the wax is obtained from its solubility to the solvent the SP value of which is known.

A variety of types and colors of organic and inorganic pigments and dyes conventionally used in the art are usable as a colorant contained in the toner of the invention.

Examples of usable black pigments include azine pigments such as carbon black, oil furnace black, channel black, lamp black, acetylene black, aniline black; metal salt azo pigments, metal oxides and composite metal oxides.

Examples of usable yellow pigments include chrome yellow, zinc yellow, cadmium yellow, yellow oxide, mineral fast yellow, nickel titanium yellow, Nables Yellow, Naphthol Yellow S, Hansa Yellow G, Hansa Yellow 10G, benzidine yellow G, benzidine yellow GR, quinoline yellow lake, permanent yellow NCG and tartrazine lake.

Examples of usable orange pigments include chrome orange, molybdenum orange, permanent orange GTR, pyrazolone orange, Vulcan Orange, Indanthrene Brilliant Orange RK, benzidine orange G and Indanthrene Brilliant Orange GK.

Examples of usable red pigments include iron oxide red, cadmium red, red lead oxide, cadmium mercury sulfide, cadmium, permanent red 4R, Lithol Red, pyrazolone red, Watching Red, calcium salt, lake red D, Brilliant Carmine 6B, eosin lake, rhodamine lake B, alizarin lake and Brilliant Carmine 3B.

Examples of usable violet pigments include manganese violet, fast violet B and methyl violet lake.

Examples of usable blue pigments include prussian blue, cobalt blue, alkali blue lake, victoria blue lake, phthalocyanine blue, metal-free phthalocyanine blue, phthalocyanine blue partial chlorine compound, Fast Sky Blue and Indanthrene Blue BC.

Examples of usable green pigments include chrome green, chrome oxide, pigment green B, malachite green lake and Fanal Yellow Green G.

These colorants may be used alone or in combination of plural types. The amount of the colorant is generally 1 to 20 parts by weight, preferably, 2 to 10 parts by weight, per 100 parts by weight of the binder resin of the toner for reasons of suitable image density and fixing properties.

The toner may contain a charge controlling agent. Examples of the charge controlling agent for use in the present invention are as follows: Nigrosine; azine dyes with an alkyl group having 2 to 16 carbon atoms as disclosed in Japanese Examined Patent Publication No. S42-1627; basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000); lake pigments of the above basic dyes (lake agent may be, for example, phosphorus tungstate, phosphorus molibdate, phosphorus tungstate molibdate, tannic acid, lauric acid, gallic acid, ferricyanates or ferrocyaniates); C.I. Solvent Black 8 (C.I. 26150), quaternary ammonium salts such as benzoylmethyl-hexadecylammonium chloride and decyl trimethyl chloride; dialkyl tin compounds such as dibutyl tin compounds and dioctyl tin compounds; dialkyl tin borate compounds; guanidine derivatives; polyamine resins such as amino-group-containing vinyl polymers and amino-group-containing condensation polymers; metal complex salts of monoazo dyes as described in Japanese Examined Patent Publications Nos. S41-20153, S43-27596, S44-6397 and S45-26478; complexes of metals, such as Zn, Al, Co, Cr and Fe with salicylic acid, naphthoic acid and dicarboxylic acid as disclosed in Japanese Examined Patent Publications Nos. S55-42752, and S59-7385; sulfonated copper phthalocyanine pigment, organic boron salts, boron-containing quaternary ammonium salts, and calixarene compounds. In the case of color toners, the use of a charge controlling agent which may impair the intended color must be avoided, and metal salts of salicyclic acid derivatives, which are white are white in color, are suitably used.

The charge control agent may preferably be used in an amount of 0.1-3 parts by weight per 100 parts by weight of the binder resin so as to retain a good triboelectric chargeability while minimizing adverse effects thereof, such as fouling of the developing sleeve surface leading to a lower developing performance and a lower environmental stability.

An external additive is present on each of the toner particles. The external additive, which may be inorganic fine particles or resin fine particles, can further improve the transferability and duration of the toner. This is because the external additive covers the wax, which lowers the transferability and duration of the toner, and because the external additive covers the surfaces of the toner particles and reduce the contact area thereof.

Fine particles of an inorganic compound such as titanium oxide, alumina, silicon carbide, silicon nitride, or boron nitride; or a resin can improve the transferability and duration of a toner when added to a mother toner as an external additive. This is because the external additive covers the wax, which lowers the transferability and duration of the toner, and because the external additive covers the surfaces of the toner particles and reduce the contact area thereof. The inorganic fine particles preferably have hydrophobized surfaces. Especially preferred is the use of hydrophobized silica fine particles or hydrophobized metal oxide fine particles such as hydrophobized titanium oxide fine particles.

As the resin fine particles, fine particles of polymethyl methacrylate or polystyrene prepared by soap-free emulsion polymerization and having an average particle size of about 0.05 to 1 μm. When the resin fine particles are used in conjunction with hydrophobized silica fine particles and hydrophobizes titanium oxide fine particles in an amount larger than that of the hydrophobized silica, a toner excellent in charge stability against humidity can be obtained.

Preferably, the inorganic particles are used in conjunction with particles having a particle size which is larger than that of external additives conventionally used, such as silica particles having a specific surface area of 20-50 $m^2/g$ and resin particles 1/100to 1/8the diameter of those of the toner for a reason of improved duration. Metal oxide fine particles externally added to the toner are tend to be buried in the mother toner particles during the process of being mixed with a carrier and triboelectrified in a fixing unit and used for fixation. Such particles having a particle size which is larger than that of the metal oxide fine particles can prevent the metal oxide fine particles from being buried in the mother toner particles. The inorganic fine particles or the resin fine particles may be contained (internally added) in the toner particles. In this case, the gridability of the toner is improved although the transferability and duration thereof are slightly lowered than when the particles are externally added. Preferably, the particles are added both internally and externally for reasons of prevention of external additive fine particles being buried in the mother toner particles and high transferability.

Examples of agents capable of imparting hydrophobicity include dimethyl dichlorosilane, trimehtylchlorosilane, methyl trichlorosilane, allyl dimethyl dichlorosilane, allyl phenyl dichlorosilane, benzyl dimethyl chlorosilane, bromomethyl dimethyl chlorosilane, α-chloroethyltrichlorosilane, p-chloroethyltrichlorosilane, chloromethyl dimethyl chlorosilane, chloromethyl trichlorosilane, p-chlorophenyltrichlorosilane, 3-chloropropyl trichlorosilane, 3-chloropropyl trimethoxysilane, vinyl triethoxysilane, vinyl methoxysilane, vinyl-tris(β-methoxyethoxy)silane, γ-methacryloxypropyltrimethoxysilane, vinyl triacetoxysilane, divinyl dichlorosilane, dimethyl vinyl chlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyl trimethoxy-silane, hexamethyl disilazane, hexaethyl disilazane, diethyl tetramethyl disilazane, hexaphenyl disilazane, and hexatolyl disilazane. In addition, titanate based coupling agent and aluminum based coupling agent can also be employed.

A cleaning property improving agent may be also used in the toner of the present invention for facilitating the removal of toner remaining on a photoconductor or a primary transfer medium after transfer. Suitable examples of such a cleaning property improving agent include fine particles of fatty acids metal salts or polyvinylidene fluoride.

The toner of the present invention can be prepared by any conventionally-known method. As a device for kneading ingredients of the toner, the following kneaders can be appropriately employed: a batch-type two-roll mixer, Banburry's mixer, a continuous two-roll extruder such as a KTK type two-axle extruder manufactured by Kobe Steel, Ltd., a TEM type two-axle extruder manufactured by Toshiba Machine Co., Ltd., a two-axle extruder made by KCK Co., Ltd., a PCM type two-axle extruder manufactured by Ikegai Tekko Co., Ltd., a KEX type two-axle extruder manufactured by Kurimoto, Ltd., and a continuous one-axle kneader such as KO-KNEADER manufactured by Buss AG. The ingredients may be suitably blended using a Henschel mixer or the like before kneading. It is possible to use a processed colorant obtained by, for example, kneading a colorant with a small amount of a resin for the purpose of obtaining uniform dispersion of the colorant. The thus obtained kneaded mixture is cooled and ground. The grinding may be performed by a combination of a coarse pulverization with a hammer mill, Rotoplex (a grinder manufactured by Hosokawa Micron Co., Ltd.) or the like and succeeding fine pulverization with a jet air pulverizer or a mechanical pulverizer. When necessary depending upon the particle size distribution of the obtained toner, the toner will be adjusted to have a desired particle size distribution by an air classifier or the like. The volume average particle size of the toner is preferably 5-20 μm for reasons of freedom of background stains or filming, improved fluidity and improved developing efficiency.

The SP value (solubility parameter δ) is defined by the following formula in the Hilderbrand-Scatchard solution theory:

$$\delta=(\Delta Ev/V)^{1/2}$$

wherein ΔEv represents the molar heat of evaporation, V represents the molar volume and ΔEv/V represents cohesive energy density. Generally, a change of heat quantity ΔHm caused by mixing is expressed by:

$$\Delta Hm=V(\delta 1-\delta 2)\cdot\Phi 1/\Phi 2$$

where δ1 represents an SP value of the solvent, δ2 represents an SP value of the solute, Φ1 represents a volume fraction of the solvent and Φ2 represents a volume fraction of the solute. The closer is δ1 to δ2, the smaller becomes the heat quantity ΔHm and the smaller becomes the Gibbs free energy. Thus, compatibility increases as the difference in SP value decreases.

The SP value of a resin may be determined from the SP value of a solvent in which the resin is most soluble. When the monomer composition of a given resin is known, the SP value of the resin may be calculated from the monomer composition using the method of Fedor (Polym. Eng. Sci., 14[2] (1974) according to the following formula:

$$SP\text{ value}=(\Sigma\Delta ei/\Sigma\Delta vi)^{1/2}$$

wherein Δei represents the atomic or atomic group heat of evaporation and Δvi represents the atomic or atomic group volume.

The grindability as used herein is defined as follows.

The toner particles were ground with an air pulverizer under specific conditions and the diameter of the pulverized particles were measured. The smaller the diameter, the higher the grindability.

The "tetrahydrofuran insolubles" as used herein is measured as follows.

A sample toner (amount W1 (about 1.0 g)) is mixed with about 50 g of tetrahydrofuran and the mixture is allowed to quiescently stand at 20° C. for 24 hours to dissolve soluble matters. The resulting mixture is centrifuged and filtered using a type 5C filter according to JIS (P3801). The filtrate is then vacuum-dried to leave a residue. The weight W2 of the residue (tetrahydrofuran soluble resin component) is measured. The weights of the tetrahydrofuran soluble and tetrahydrofuran insoluble components other the resin component are measured by thermal analysis such as DSC-TG and thermogravimetry and are defined as W3 and T4, respectively. The tetrahydrofuran insoluble content (% by weight) is calculated according to the following equation:

$$\text{Toluene insolubles}=(W1-W2-W3)/(W1-W3-W4)\times 100$$

In the present specification, the molecular weight distribution of a resin is measured by gel permeation chromatography (GPC). The gel permeation chromatography is performed as follows: A column is stabilized in a chamber heated to 40° C., through which THF is allowed to flow at a flowing speed of 1 ml/min. Then, 50 to 200 μl of a THF solution of a sample to be measured having a concentration of from 0.05 to 0.6% by weight, is injected into the column with a syringe having a tip end to which a filter unit is connected. Elution is then started to determine the molecular distribution of the sample. Similar operations are performed with respect to several standard polystyrene resins, which have different molecular weights and each of which has a single molecular weight, to prepare a calibration curve. It is preferable to use at least about ten standard polystyrenes to prepare the calibration curve. Polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ which are manufactured by Pressure Chemical Co., or Tosoh Corp. are exemplified as the standard polystyrenes. As a detector, RI (refractive index) detector is used.

The following examples will further illustrate the present invention. Parts are by weight.

EXAMPLE 1

| Preparation of Carrier | |
|---|---|
| Acrylic resin solution (solid content: 50 wt %) | 42.0 parts |
| Guanamine solution (solid content: 50 wt %) | 13.0 parts |
| Toluene | 60 parts |
| Butyl cellosolve | 60 parts |

The above ingredients were dispersed for 10 minutes with a homomixer to obtain a solution for an acrylic resin coating. The solution was applied on sintered ferrite powder particles (F-300; average particle size: 50 μm, made by Powder Tech Co., Ltd.) as a core material to a thickness of 0.15 μm with Spira Coater (manufactured by Okada Seiko Co., Ltd.) and dried. The coated ferrite powder particles were then sintered at 150° C. for one hour in an electric furnace. On cooling, the ferrite powder bulk was crushed with a 106 μm sieve to obtain a carrier. The thickness of the surface layer is an average of measurements obtained by observing cross-sections of the carrier particles with a transmission electron microscope.

| Preparation of Toner | |
|---|---|
| Polyester resin (A1)<br>(THF insoluble: 0, weight average molecular weight: 7,000, Tg: 68° C., SP value: 11.3) | 50 parts |
| Polyester resin (B1)<br>(THF insoluble: 30, weight average molecular weight: 10,000, Tg: 61° C., SP value: 10.7) | 50 parts |
| Carnauba wax<br>(melting point: 82° C., penetration: 1.2, SP value: 8) | 5 parts |
| Charge controlling agent<br>(metal salt of a salicylic acid derivative) | 2 parts |
| Colorant<br>(carbon black) | 8 parts |

The above ingredients were well mixed with a blender and kneaded in a two-axle extruder. On cooling, the kneaded mixture was ground and classified, thereby obtaining a black mother toner having a volume average particle size of about 7.5 μm.

Hydrophobic silica particles (having subjected to surface treatment with hexamethyldisilazane, average particle size of primary particles: 0.02 μm) as an external additive was mixed with the mother toner in an amount of 0.4 parts per 100 parts of the mother toner to obtain a black toner.

The toner had a THF insoluble of 0% and a maximum particle size of 18 μm, and the wax in the toner had a maximum major diameter of 5 μm. As a result of observation with a transmission electron microscope, it was confirmed that the resin B1 was dispersed like islands in the resin A1 and contained the wax.

5 Parts of the toner and 95 parts of the carrier were mixed to obtain a developer having a toner concentration of 5% by weight. The gloss, offset properties, transferability, grindability, charge stability against humidity, reduction in charge amount and variation of resistivity of the developer were evaluated. The results are summarized in Tables 1 and 2.

The methods and conditions of evaluations in the example are as follows.

Gloss

A color copying machine, Preter 650, manufactured by Ricoh Company, Ltd., in which the fixing roller was exchanged for a roller covered with a PFA tube and from which the silicone oil applying unit was removed, was adjusted such that 1.0±0.1 mg/cm$^2$ of toner was developed. The gloss of a solid image produced at a surface temperature of the fixing roller of 160° C. was measured at an incident angle of 60° with a gloss meter manufactured by Nippon Denshoku Industries Co., Ltd. As the transfer sheet, Full Color PPC Paper Type 6000<70W, manufactured by Ricoh Company, Ltd. was used.

The higher value, the higher gloss the image has. The evaluation criteria are different between monochrome toners and color toners. Monochrome toners are mainly used to make a copy or print with a relatively small image area such as a character image and a low-gloss image tends to be preferred since characters with high gloss are difficult to read. Color toners are mainly used to make a copy or print with a high image area such as photographs and a high-gloss image is preferred since a log-gloss color image is lacking in sharpness. To obtain an image with high sharpness and color reproduction, a gloss of at least 10% is necessary.

The fixing roller is a silicone rubber roller having a thickness of 2 mm and covered with a PFA tube with a thickness of 25 μm. The fixing pressure is 80 kg and the nip width is 8 mm. The fixing roller side face of the nip is concavely curved. The output of the heater of the fixing roller is 650 W, and the output of the heater of the pressure roller is 400 W.

Offset Properties

In the same copying machine that was used in the evaluation of gloss, the temperature of the fixing roller was increased by 5° C. at a time and the temperature at which offset started to take place was observed. The evaluation was conducted without applying oil on the fixing roller. As the transfer sheet, Full Color PPC Paper Type 6000<70W, manufactured by Ricoh Company, Ltd. was used. The evaluation criteria are as follows:

A: Excellent; offset did not take place up to a very high temperature (240° C.).

B: Good; offset did not take place up to a high temperature (210° C.).

C: Fair; satisfactory anti-offset properties were able to be obtained with application of a minor amount of silicone oil (0.5-1 mg/A4 size) to the fixing roller.

D: Not good; offset took place at a low temperature (150° C.) and satisfactory anti-offset properties were not able to be obtained even if a minor amount of silicone oil was applied to the fixing roller.

Transferability

The same copying machine that was used in the evaluation of gloss was used. The copying machine was stopped during a transfer process and the amount of toner remaining on the intermediate transfer belt was observed with naked eyes.

A: Excellent; the amount of remaining toner was very small.

B: Good; the amount of remaining toner was small.

C: Fair; the transferability was almost the same as conventional wax-containing toners.

D: Not good; the amount of remaining toner was very large.

Duration

The toner was charged in a commercially available digital copying machine (imagio Color 2800, manufactured by Ricoh Company, Ltd.) and 300,000 copies of a black monochrome image were produced. The reduction in the charge amount and the variation in the resistivity of the carrier after the running were checked.

The reduction in the charge amount herein was the difference between the charge amount of the carrier in tiboelectrified developer and the charge amount of the carrier after the running. The measurement was made with a blow off method with a blowoff device TB-200, manufactured by Toshiba Chemical Corporation. The target value was 5.0 (μc/g) or lower. The cause of the reduction in charge amount is the toner spent phenomenon. Thus, the reduction of charge amount can be reduced by decreasing accumulation of toner fine particles.

The variation in resistivity was obtained as follows. A sample carrier before being mixed with the toner was placed between resistivity measuring parallel electrodes with a gap of 2 mm and a DC voltage of 250 V was applied thereto. Thirty seconds later, the resistivity was measured and the value was converted into a volume resistivity. The volume resistivity of a sample carrier after the running, which was obtained by removing the toner from the developer with the above blowoff device, was obtained in the same manner. The variation in resistivity herein is the difference of the volume resistivities. The target value is 2.0 (Log (Ω·cm)) in absolute value. The variation of resistivity is caused by scraping of binder resin of the carrier, toner spent, separation of large particles from the carrier surface layer. Thus, the variation in resistivity can be reduced by decreasing them.

Charge Stability Against Humidity

The developer was measured for the charge amount under conditions of 10° C. and 15% RH and under conditions of 30° C. and 90% RH by a blow off method. The environmental fluctuation rate of the developer is defined by the following equation:

$$\text{Environmental fluctuation rate}=2(L-H)/(L+H)\times 100\ (\%)$$

wherein L and H are the absolute values of the charge amounts measured under conditions of 10° C. and 15% RH and under conditions of 30° C. and 90% RH, respectively.

The environmental fluctuation rate is preferably about 40% or lower, more preferably not higher than 20%.

The evaluation criteria are as follows:

A: Excellent; the environmental fluctuation rate is lower than 20%.

B: Good; the environmental fluctuation rate is not lower than 20% and lower than 40%.

C: Fair; the environmental fluctuation rate is not lower than 40% and lower than 70%.

D: Not good; the environmental fluctuation rate is higher than 70%.

Structure of Toner Particle

Toner particles were buried in an epoxy resin and a super thin piece was sliced off. On dyeing with $RuO_4$ or the like, the super thin piece was observed with a transmission electron microscope.

EXAMPLE 2

| Preparation of Toner | |
|---|---|
| Polyester resin (A2) (THF insoluble 0, weight average molecular weight: 17,000, Tg: 59° C., SP value: 10.8) | 80 parts |
| Styrene-methyl acrylate resin (B2) (THF insoluble: 0, weight average molecular weight: 15,000, Tg: 62° C., SP value: 9.3) | 15 parts |
| Polyethylene wax (melting point: 99° C., penetration: 1.5, SP value: 8.1) | 5 parts |
| Charge controlling agent (metal salt of a salicylic acid derivative) | 2 parts |
| Colorant (copper phthalocyanine blue pigment) | 2.5 parts |

The resin B2 has grindability which is higher than those of the resin A2 and the polyethylene wax.

The above ingredients were made into a toner in the same manner as in Example 1, thereby obtaining a cyan toner having a volume average particle size of about 7.5 μm.

The toner had a THF insoluble of 0%, a maximum particle size of 18 μm, and the wax contained in the toner had a maximum major diameter of 7 μm. As a result of observation with a transmission electron microscope, it was confirmed that the resin B2 was dispersed like islands in the resin A2 and contained the wax.

5 Parts of the toner and 95 parts of the carrier were mixed and agitated to obtain a developer having a toner concentration of 5% by weight. The developer was evaluated in the same manner as in Example 1, The results are summarized in Tables 1 and 2.

EXAMPLE 3

| Preparation of Carrier | |
|---|---|
| Acrylic resin solution (solid content: 50 wt %) | 21.0 parts |
| Guanamine solution (solid content: 70 wt %) | 6.4 parts |
| Silicone resin solution (solid content: 23 wt %, SR2410 made by Toray Dow Corning Silicone Inc.) | 65.0 parts |
| Amino silane (solid content: 100 wt %, SH6020 made by Toray Dow Corning Silicone Inc.) | 0.3 parts |
| Toluene | 60 parts |
| Butyl cellosolve | 60 parts |

The above ingredients were dispersed for 10 minutes with a homomixer to obtain a solution for a coating of a blend of an acrylic resin and a silicone resin. Then, a carrier was prepared using the solution in the same manner as in Example 1.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 4

| Preparation of Carrier | |
|---|---|
| Acrylic resin solution (solid content: 50 wt %) | 21.0 parts |
| Guanamine solution (solid content: 70 wt %) | 6.4 parts |
| Toluene | 60 parts |
| Butyl cellosolve | 60 parts |

The above ingredients were dispersed for 10 minutes with a homomixer to obtain a solution for an acrylic resin coating. The solution was applied on sintered ferrite powder particles (F-300; average particle size: 50 μm, made by Powder Tech Co., Ltd.) as a core material to a thickness of 0.08 μm with Spira Cota (manufactured by Okada Seiko Co., Ltd.) and dried.

| | |
|---|---|
| Silicone resin solution (solid content: 23 wt %, SR2410 made by Toray Dow Corning Silicone Inc.) | 65.0 parts |
| Amino silane (solid content: 100 wt %, SH6020 made by Toray Dow Corning Silicone Inc.) | 0.3 parts |
| Toluene | 60 parts |
| Butyl cellosolve | 60 parts |

The above ingredients were dispersed in a vessel with an agitator to obtain a solution for a silicone resin coating. The solution was applied on the sintered ferrite powder particles on which the acrylic resin layer had been formed such that the total thickness of the acrylic resin layer and the silicone resin layer was 0.15 μm and dried. The ferrite powder particles were then sintered at 150° C. for one hour in an electric furnace. On cooling, the ferrite powder bulk was crushed with a 106 μm sieve to obtain a carrier coated with a coating film having a two layer structure with an upper layer of acrylic resin layer and the silicone resin and a lower layer of a silicone resin.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 5

| Preparation of Carrier | |
|---|---|
| Acrylic resin solution (solid content: 50 wt %) | 21.0 parts |
| Guanamine solution (solid content: 70 wt %) | 6.4 parts |
| Alumina particles (0.3 μm, resistivity: $10^{14}$ (Ω · cm)) | 7.6 parts |
| Silicone resin solution (solid content: 23 wt %, SR2410 made by Toray Dow Corning Silicone Inc.) | 65.0 parts |
| Amino silane (solid content: 100 wt %, SH6020 made by Toray Dow Corning Silicone Inc.) | 0.3 parts |
| Toluene | 60 parts |
| Butyl cellosolve | 60 parts |

The above ingredients were dispersed for 10 minutes with a homomixer to obtain a solution for a coating of a blend of an acrylic resin and a silicone resin containing alumina particles. Then, a carrier was prepared using the solution in the same manner as in Example 1, thereby obtaining a carrier with a surface layer containing 20% by weight of alumina, having a D/h of 2.0.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 6

| Preparation of Carrier | |
|---|---|
| Acrylic resin solution (solid content: 50 wt %) | 21.0 parts |
| Guanamine solution (solid content: 70 wt %) | 6.4 parts |
| Alumina particles (0.3 μm, resistivity: $10^{14}$ (Ω · cm)) | 121.0 parts |
| Silicone resin solution (solid content: 23 wt %, SR2410 made by Toray Dow Corning Silicone Inc.) | 65.0 parts |
| Amino silane (solid content: 100 wt %, SH6020 made by Toray Dow Corning Silicone Inc.) | 0.3 parts |
| Toluene | 300 parts |
| Butyl cellosolve | 300 parts |

The above ingredients were dispersed for 10 minutes with a homomixer to obtain a solution for a coating of a blend of an acrylic resin and a silicone resin containing alumina particles. Then, a carrier was prepared using the solution in the same manner as in Example 1, thereby obtaining a carrier with a surface layer containing 80% by weight of alumina, having a D/h of 2.0.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 7

A carrier was prepared in the same manner as in Example 6 except that 121.0 parts of titanium oxide particles (0.3 μm, resistivity: $10^7$ (Ω·cm)) were used in place of the alumina particles.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 8

A carrier was prepared in the same manner as in Example 6 except that 121.0 parts of zinc oxide particles (0.3 μm, resistivity: 107 (Ω·cm)) was used in place of the alumina particles.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 9

A carrier was prepared in the same manner as in Example 6 except that alumina particles having a particle size of 0.12 μm were used, thereby obtaining a carrier having a D/h of 0.8.

95 Parts of the carrier and 5 parts of the toner obtained in Example 2 were mixed and agitated to obtain a developer having a toner concentration of 5% by weight. The developer was evaluated in the same manner as in Example 1, The results are summarized in Tables 1 and 2.

EXAMPLE 10

A toner was prepared in the same manner as in Example 2 except that a strong shear force was applied in kneading the ingredients, thereby obtaining a toner having the same constitution as the tone of Example 2 except that the maximum major diameter of the wax was 5 μm.

5 Parts of the toner and 95 parts of the carrier obtained in Example 6 were mixed to obtain a developer having a toner concentration of 5% by weight. The developer was evaluated in the same manner as in Example 1. The results are summarized in Tables 1 and 2.

EXAMPLE 11

A toner was prepared in the same manner as in Example 2 except that 80 parts of a polyol resin (A3) (THF insoluble: 0, weight average molecular weight: 18,000, Tg: 60° C., SP value: 11.1) was used in place of the resin A1.

The resin B2 has grindability which is higher than those of the resin A3 and the polyethylene wax.

The toner had a THF insoluble of 0%, a maximum particle size of 18 μm, and the wax in the toner had a maximum major diameter of 5 μm. As a result of observation with a transmission electron microscope, it was confirmed that the resin B2 was dispersed like islands in the resin A3 and contained the wax.

5 Parts of the toner and 95 parts of the carrier obtained in Example 6 were mixed and agitated to obtain a developer having a toner concentration of 5% by weight. The developer was evaluated in the same manner as in Example 1, The results are summarized in Tables 1 and 2.

EXAMPLE 12

A toner was prepared in the same manner as in Example 2 except that a synthetic ester wax (melting point: 84° C., penetration: 1, SP value: 8.8) grafted with styrene, butyl acrylate and an acrylonitrile copolymer resin (B3; THF insoluble: 0, weight average molecular weight: 15,000, Tg: 63° C., SP value: 10.2) was used in place of the resin B1.

The resin B3 has grindability which is higher than those of the resin A3 and the polyethylene wax.

The toner had a THF insoluble of 0%, a maximum particle size of 18 μm, and the wax in the toner had a maximum major diameter of 7 μm. As a result of observation with a transmission electron microscope, it was confirmed that the resin B3 was dispersed like islands in the resin A3 and contained the wax.

5 Parts of the toner and 95 parts of the carrier obtained in Example 6 were mixed to obtain a developer having a toner concentration of 5% by weight. The developer was evaluated in the same manner as in Example 1. The results are summarized in Tables 1 and 2.

EXAMPLE 13

| Preparation of Carrier | |
|---|---|
| Acrylic resin solution (solid content: 50 wt %) | 2.2 parts |
| Guanamine solution (solid content: 70 wt %) | 0.7 parts |
| Silicone resin solution (solid content: 23 wt %, SR2410 made by Toray Dow Corning Silicone Inc.) | 126.0 parts |
| Amino silane (solid content: 100 wt %, SH6020 made by Toray Dow Corning Silicone Inc.) | 0.63 parts |
| Toluene | 60 parts |
| Butyl cellosolve | 60 parts |

The above ingredients were dispersed for 10 minutes with a homomixer to obtain a solution for a coating of a blend of an acrylic resin and a silicone resin. Then, a carrier was prepared using the solution in the same manner as in Example 1, thereby obtaining a carrier with an acrylic resin content of 5% by weight.

95 Parts of the carrier and 5 parts of the toner obtained in Example 2 were mixed to obtain a developer having a toner concentration of 5% by weight. The developer was evaluated in the same manner as in Example 1. The results are summarized in Tables 1 and 2.

EXAMPLE 14

A carrier was prepared in the same manner as in Example 6 except that alumina particles having a diameter of 2.3 μm were used, thereby obtaining a carrier having the same constitution as the carrier of Example 6 except that the D/h was 15.

95 Parts of the carrier and 5 parts of the toner obtained in Example 2 were mixed and agitated to obtain a developer having a toner concentration of 5% by weight. The developer was evaluated in the same manner as in Example 1, The results are summarized in Tables 1 and 2.

COMPARATIVE EXAMPLE 1

| Preparation of Carrier | |
|---|---|
| Silicone resin solution (solid content: 23 wt %, SR2410 made by Toray Dow Corning Silicone Inc.) | 132.2 parts |
| Amino silane (solid content: 100 wt %, SH6020 made by Toray Dow Corning Silicone Inc.) | 0.66 parts |
| Alumina particles (0.3 μm, resistivity: $10^{14}$ (Ω · cm)) | 121.0 parts |
| Toluene | 300 parts |
| Butyl cellosolve | 300 parts |

The above ingredients were dispersed for 10 minutes with a homomixer to obtain a solution for a coating of a blend of an acrylic resin and a silicone resin containing alumina particles. Then, a carrier was prepared using the solution in the same manner as in Example 1.95 Parts of the carrier and 5 parts of the toner obtained in Example 2 were mixed to obtain a developer having a toner concentration of 5% by weight. The developer was evaluated in the same manner as in Example 1, The results are summarized in Tables 1 and 2.

COMPARATIVE EXAMPLE 2

A toner was prepared in the same manner as in Example 2 except that no resin B1 was used and the resin A2 was increased to 95 parts instead. 5 Parts of the toner and 95 parts of the carrier obtained in Example 6 were mixed to obtain a developer having a toner concentration of 5% by weight. The developer was evaluated in the same manner as in Example 1, The results are summarized in Tables 1 and 2.

COMPARATIVE EXAMPLE 3

A toner was prepared in the same manner as in Example 2 except that a polyester resin (A4) (THF insoluble: 0, weight average molecular weight: 2,500, Tg: 60° C., SP value: 10.8) was used in place of the resin A2. The toner had a THF insoluble of 0%, a maximum particle size of 18 μm, and the wax in the toner had a maximum major diameter of 8 μm. As a result of observation with a transmission electron microscope, it was confirmed that the resin B2 was dispersed like islands in the resin A4 and contained the wax. 5 Parts of the toner and 95 parts of the carrier obtained in Example 6 were mixed to obtain a developer having a toner concentration of 5% by weight. The developer was evaluated in the same manner as in Example 1, The results are summarized in Tables 1 and 2.

COMPARATIVE EXAMPLE 4

A toner was prepared in the same manner as in Example 2 except that a polyester resin (A5) (THF insoluble: 2 wt %, weight average molecular weight: 100,000, Tg: 61° C., SP value: 10.8) was used in place of the resin A2, The toner had a THF insoluble of 1% by weight, a maximum particle size of 18 μm, and the wax in the toner had a maximum major diameter of 5 μm. As a result of observation with a transmission electron microscope, it was confirmed that the resin B2 was dispersed like islands in the resin A5 and contained the wax. 5 Parts of the toner and 95 parts of the carrier obtained in Example 6 were mixed to obtain a developer having a toner concentration of 5% by weight. The developer was evaluated in the same manner as in Example 1, The results are summarized in Tables 1 and 2.

COMPARATIVE EXAMPLE 5

5 Parts of the mother toner obtained in Example 2 (without the external additive) and 95 parts of the carrier obtained in Example 6 were mixed to obtain a developer having a toner concentration of 5% by weight. The developer was evaluated in the same manner as in Example 1, The results are summarized in Tables 1 and 2.

TABLE 1

| Ex. | Gloss (%) | Offset Properties | Transferability | Grindability | Environmental fluctuation rate |
|---|---|---|---|---|---|
| 1 | 4 | B | B | good | B |
| 2 | 25 | B | B | good | B |
| 3 | 25 | B | B | good | B |
| 4 | 25 | B | B | good | B |
| 5 | 25 | B | B | good | B |
| 6 | 25 | B | B | good | B |
| 7 | 25 | B | B | good | B |
| 8 | 25 | B | B | good | B |
| 9 | 25 | B | B | good | B |
| 10 | 25 | B | B | good | B |
| 11 | 25 | B | B | good | B |
| 12 | 28 | B | A | good | B |
| 13 | 25 | B | B | good | B |
| 14 | 25 | B | B | good | B |
| Comp. 1 | 25 | B | B | good | B |
| Comp. 2 | 39 | B | D | no good | D |
| Comp. 3 | 51 | D | B | good | B |
| Comp. 4 | 1.3 | A | B | good | B |
| Comp. 5 | 26 | B | D | good | B |

TABLE 2

| Ex. | Duration | |
|---|---|---|
| | Reduction in charge amount (μc/g) | Variation in resistivity Log (Ω · cm) |
| 1 | 3.7 | 1.7 |
| 2 | 4.7 | 1.9 |
| 3 | 3.1 | 1.5 |
| 4 | 3.4 | 1.0 |
| 5 | 2.3 | 1.4 |
| 6 | 1.2 | 0.8 |
| 7 | 1.4 | 0.7 |
| 8 | 1.3 | 0.7 |
| 9 | 3.2 | 1.4 |
| 10 | 1.0 | 0.7 |
| 11 | 1.3 | 1.0 |
| 12 | 0.9 | 0.5 |
| 13 | 4.9 | 1.9 |
| 14 | 3.8 | 1.9 |
| Comp. 1 | 11.3 | −2.8 |
| Comp. 2 | Running aborted when 20,000 copies were produced because of too low transferability. | |
| Comp. 3 | Running aborted because of too low anti-hot offset properties. | |
| Comp. 4 | Running aborted when 20,000 copies were produced because of too low gloss. | |
| Comp. 5 | Running aborted when 5,000 copies were produced because of too low transferability. | |

The developer of the present invention are unlikely to have problems of accumulation of toner fine particles on the carrier surfaces and flaking of the binder resin of the carrier and thus can have stable charge amount and electric resistivity. The toner of the present invention includes toner particles each comprising a matrix of the first resin and a plurality of domains of the second resin dispersed like islands in the matrix and containing a wax. Since the amount of wax exposed on the surface of the toner particles can be reduced, the toner can contain a larger amount of wax than conventional toners do. Thus, the toner of the present invention has improved anti-offset properties and can solve the problems of decrease in transferability and duration, which is peculiar to a toner containing a wax. Also, since the grindability of the toner is high, toner particles with a small particle size can be produced with high efficiency. The color developer of the present invention has high transferability and duration and can produce images with adequate gloss and high color reproduction.

Therefore, image deterioration which increases with increase of the number of copies produced can be prevented and high quality images can be obtained over a long period of time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2002-081601, filed Mar. 22, 2002, inclusive of the specification and claims, are hereby incorporated by reference herein.

What is claimed is:

1. A developer for developing an electrostatic latent image, compnsing:

a carrier which comprises core particles and a surface layer comprising a resin binder which comprises an acrylic resin and a silicone resin surrounding each of said core particles; and a toner which comprises toner particles and an external additive of inorganic or resin fine particles present on each of said toner particles, wherein each of said toner particles comprises a colorant, a matrix of a first resin, domains of a second resin and a wax;

wherein a plurality of domains of said second resin is dispersed in said matrix of said first resin, and wherein said second resin substantially contains said wax, said first resin, said second resin and said wax being insoluble in each other, said first resin is substantially free of tetrahydrofuran insoluble matters and has a weight average molecular weight of 3,000 to 90,000, and said surface layer comprises a first layer comprising said acrylic resin and a second layer comprising said silicone resin, said first and second layers being provided one over the other in either order to form a laminate;

wherein said surface layer of said carrier further comprises particles in an amount of 40 to 95% by weight based on a total weight of said particles and said resin binder, said particles having an average particle diameter which satisfies the following condition:

$$1<D/h<10$$

wherein D represents the particle diameter of said particles and h represents the thickness of said surface layer.

2. A developer as claimed in claim 1, wherein said surface layer particles are selected from the group consisting of alumina particles, titanium oxide particles, zinc oxide particles, surface-treated products thereof and mixtures thereof.

3. A developer as claimed in claim 1, wherein said first resin is at least one resin selected from the group consisting of a polyester resin and polyol resin.

4. A developer as claimed in claim 1, wherein said second resin is a modified wax grafted with a vinyl resin.

5. A developer as claimed in claim 1, wherein said wax has a maximum dispersion diameter of at least 0.5 μm and not greater than one-third the diameter of said toner particles in the major axis thereof.

6. A developer as claimed in claim 1, wherein said wax has a melting point of 70 to 125° C. and a penetration of 5.

7. A developer as claimed in claim 1, wherein said toner is a first color toner, and said color toner is combined with at least one other color toner having a different color than said first color toner to form a full color image.

8. A method for forming an image, said method comprising:

developing an electrostatic latent image with said developer as claimed in claim 1.

* * * * *